United States Patent [19]

Smith

[11] Patent Number: 4,704,138

[45] Date of Patent: Nov. 3, 1987

[54] SPOUTED BED HEATING OF SOLIDS FOR COAL GASIFICATION

[75] Inventor: Robert H. Smith, Katy, Tex.

[73] Assignee: Atlantic Richfield Company, Los Angeles, Calif.

[21] Appl. No.: 447,355

[22] Filed: Dec. 6, 1982

[51] Int. Cl.[4] ..... C10J 3/54

[52] U.S. Cl. ..... 48/210; 48/206; 201/12

[58] Field of Search ..... 48/202, 206, 210, 197 R, 48/DIG. 4; 252/373; 201/12, 16, 38

[56] References Cited

U.S. PATENT DOCUMENTS

| | | | |
|---|---|---|---|
| B541,376 | 2/1976 | Chen et al. | 48/DIG. 4 X |
| 2,786,280 | 3/1957 | Gishler et al. | 208/153 |
| 3,912,465 | 10/1975 | Kunii et al. | 48/202 X |
| 4,125,453 | 11/1978 | Tamm et al. | 201/12 X |
| 4,312,639 | 1/1982 | Johnson | 48/210 |

*Primary Examiner*—Barry S. Richman
*Assistant Examiner*—Joye L. Woodard
*Attorney, Agent, or Firm*—M. David Folzenlogen

[57] ABSTRACT

In a coal or coal char gasification system using hot recycled inert heat transfer medium (IHTM) solids, the heat transfer medium and some of the unreacted or ungasified char are passed through a spouted-bed reactor. In the spouted-bed reactor, the unreacted char is burned in a way that more efficiently reheats the heat transfer medium and reduces fusion, agglomeration, plugging, fouling and erosion problems. These advantages are provided by the fact that only a central spout of solids is fluidized and the fact the solids undergo a systematic cyclic mechanism where there is greater contact between the hot char and IHTM solids. The spouted-bed produces a hydrodynamic system which is substantially different from conventional gas-solid combustor configurations, especially fluidized combustors.

4 Claims, 1 Drawing Figure

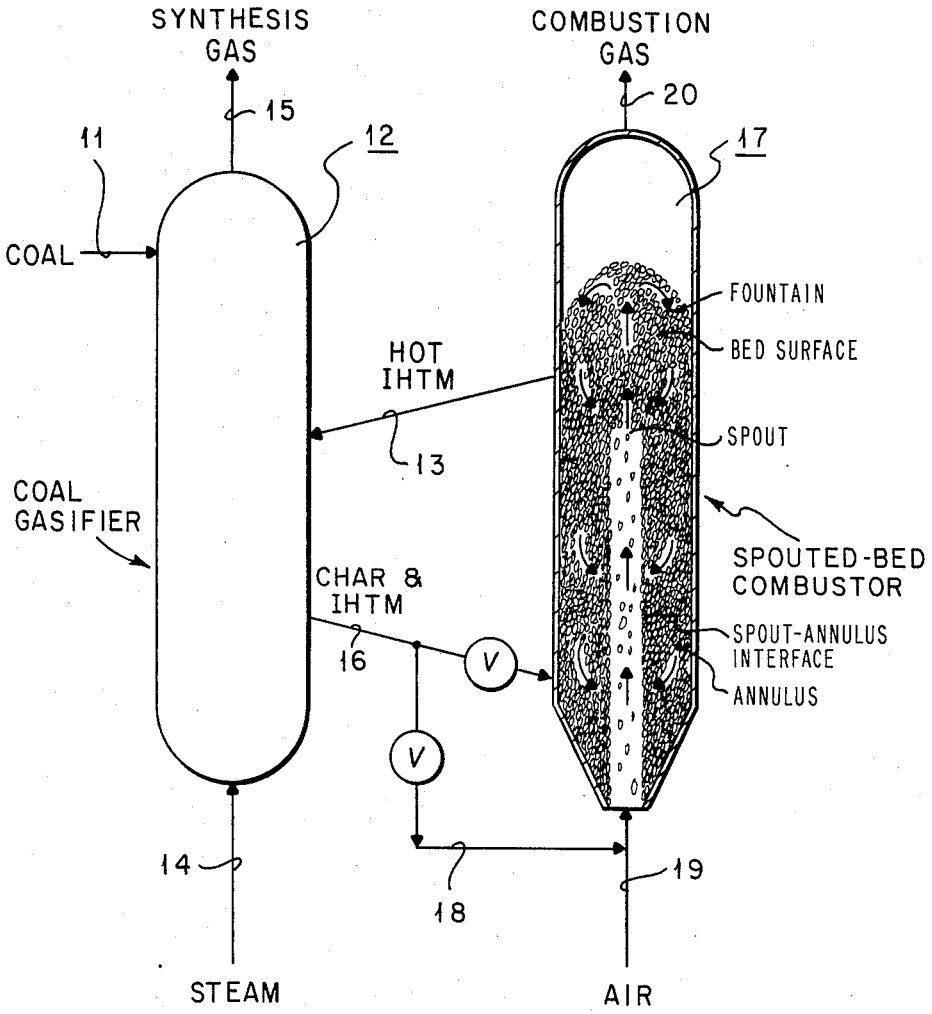
SYNTHESIS GAS
15
11
12
COAL
COAL GASIFIER
HOT IHTM
13
CHAR & IHTM
16
V
V
14
18
STEAM
COMBUSTION GAS
20
17
FOUNTAIN
BED SURFACE
SPOUT
SPOUTED-BED COMBUSTOR
SPOUT-ANNULUS INTERFACE
ANNULUS
19
AIR

SPOUTED BED HEATING OF SOLIDS FOR COAL GASIFICATION

BACKGROUND OF THE INVENTION

This invention generally relates to the gasification of coal with an inert heat transfer medium (IHTM). More particularly, this invention is concerned with more efficient reheating of the IHTM with increased solid-to-solid contact between the IHTM and hot char.

Coal may be gasified using steam and hot IHTM solids. The particular details of the coal gasification reaction form no part of this invention and a detailed description of this reaction is not required.

The coal gasification reaction produces a mixture of ash, unreacted char and IHTM. All or a part of char is burned to provide heat for reheating the IHTM. The reheated IHTM is cycled back to the coal gasifier. In general, two systems for burning the char and reheating the IHTM have been proposed. In one system, the char and ash are separated from the IHTM and then the char is burned to produce a hot gas. This gas is then used to reheat the IHTM. The rate of heat transfer between the hot gas and the lack of uniform heating make this system inefficient unless multiple beds are used.

In the second system, the char, ash and IHTM are fed to a fluidized combustor or lift pipe where the unreacted char is burned. The dilute-phase fluidized system combustor for burning the unreacted char and reheating the IHTM has a number of shortcomings. For example, the particle residence is short and there is very little contact between the solids. The heat from burning the char is transferred to the gas and then to the IHTM solids. Computer modelling of this poor heat transfer mechanism and the short residence time indicates that the IHTM solids will likely be several hundred degrees below that of the char particles and that the temperature of the burning char particles can, therefore, exceed the ash fushion temperature. Fusion of the ash in the char could cause agglomeration of the char and cause plugging, slugging and fouling. Fluidized IHTM reheating systems are naturally hydrodynamically unstable and sensitive to gas rates, gas-to-solids ratios and particle sizes. Fluidizing a mixture of ash, char and IHTM also causes equipment erosion problems.

SUMMARY OF THE INVENTION

In the IHTM reheating stage of this disclosure, char, ash and IHTM solids are fed from a coal gasifier into a spouted-bed combustor. A spouted-bed combustor produces a hydrodynamic system which is substantially different from conventional packed or fluidized bed combustors. For example, only a central spout of solids is fluidized thereby eliminating erosion of the equipment by the fluidized solids. The fluidized, burning or hot char particles fall into a downwardly moving bed so that there is greater contact between the char and the IHTM solids thereby increasing the temperature of the IHTM solids and reducing the temperature difference between these solids. The upper part of bed acts as a dense phase countercurrent combustor with increased gas-to-solids and solids-to-solids contact thereby increasing the heating efficiency of combustor and further reducing the chances of excessive char and ash temperatures. In addition, the unreacted char and IHTM solids undergo a cyclic movement downward and radially toward the spout where solids not removed from the combustor are fluidized again in the spout.

BRIEF DESCRIPTION OF THE DRAWING

The process of this invention is hereinafter more fully described having reference to the drawing which provides a partly schematical, party diagrammatical flow illustration of a system for carrying out the coal gasification, IHTM reheating process of this invention.

DESCRIPTION OF THE PREFERRED EMBODIMENT

More specifically, coal which has been mixed and pulverized, crushed or ground to a predetermined suitable size is fed through coal inlet line 11 into coal purification reactor or gasifier 12. The coal may have been subjected to prior treatment, for example, pyrolysis to drive off hydrocarbons that are readily vaporized.

At the same time, inert heat transfer medium (IHTM) is fed by way of hot IHTM line 13 into coal gasifier 12. The IHTM is substantially hotter than the coal and is hot enough to provide heat to cause or assist in gasifying coal, for example, hotter than 1200° F. If desired, the coal and IHTM may be initially fed to a suitable hopper or accumulator (not shown) and then the mixture fed into coal gasifier 12.

The IHTM is comprised of subdivided or particulate bodies or solids which are substantially inert. Generally, the particulate IHTM material should be substantially refractory so as to withstand the high temperatures of the coal gasification and reheating stages without disintegrating or otherwise thermally decomposing. Various refractory materials in the form of small spheres or irregularly shaped particles can be employed. These spheres or particles or other shaped particles will be above the minimum size below which a bed of the solids will not form a spouted bed. The refractory solids, therefore, will usually have a minimum size of not less than about 1 mm, that is, plus (retained on) 20 mesh (U.S. Standard Sieve). There is no real maximum size other than the fact that IHTM particles must be capable of being fluidized in a spout through a bed of the solids and conveyed up the spout in the fluidized state. Generally, particles of from about plus 20 mesh to about three-fourths of an inch are typical.

The particulate material can be composed of any substantially inert material such as, for example, alumina, beryllia, zirconia, mullite, periclase, silicon carbide, clays, silicates, synthetic metal oxide gels, metals (including alloys of two or more metals), combinations of two or more of the foregoing, and the like. A particularly useful IHTM material is sand in its normally occurring particle size range. Other inert refractory materials obvious to those skilled in the art can also be employed in this invention in any size range so long as they can be used in a spouted-bed combustor without causing spout instability.

While the coal and hot IHTM are being fed into coal gasifier 12, steam is fed into the reaction chamber, for example, into the lower part of coal gasifier 12 by way of steam inlet line 14. The reaction product gases or synthesis gas and vapors are removed through overhead line 15. A mixture of unreacted char and IHTM with some ash is removed from the coal gasifier through solids exit line 16.

This mixture, unreacted char, IHTM solids and ash may be fed directly into spouted-bed combustor 17 or some of the ash may first be separated from the mixture by elutriation or other known means. As shown, the char and IHTM solids from the coal gasifier are fed into the annulus via line 16 at a point in the lower half of the combustor, but these solids may be fed at any point in combustor. Moreover, as previously mentioned, all or any part of the char and IHTM solids may be fed via line 18 directly into air inlet line 19. Splitting the flow of char and solids into two streams provides a way of changing or controlling the concentration of solids in the spout.

An oxidizing or combusting supporting gas, for example, oxygen, air, or a mixture of air and fuel gas generated in the overall process, or carbon dioxide or flue gas with the desired amount of free oxygen, or the like, which may or may not have been preheated to char ignition temperatures, is blown into the char combustor via gas inlet line 19. The oxidizing gas performs two functions. It causes the unreacted char to burn and provide heat for reheating the IHTM solids and it is introduced into spouted-bed combustor 17 in a manner such that a spouted bed is formed. The total quantity of gas flowed through inlet 19 is primarily dependent on the formation of a stable spouted bed. The total quantity of combusting supporting materials in the gas affects the amount of char burned and the heat generated by burning and in turn the temperature of the solids. Other factors taken into consideration during burning of the char are the particle size, vessel size, residence burning time, desired outlet temperature, heat losses and heat inputs, and the like. Additional fuel material or gases may be used to supplement the char if this is necessary. Steam and other gases may also be used to control burning or provide the desired quantities of total gas. Moreover, gas may be injected into the spouted-bed combustor at other points (not shown) to control the burning and reheating parts of the system.

In spouted-bed combustor 17, a hydrodynamic equilibrium is established. This causes gas-solids results which cannot be achieved in a fluidized bed combustor or a packed bed hot gas-solids heat exchanger. The oxidizing gas contacts and causes burning or oxidation of the unreacted char and supplemental fuel, if any is added, to produce heat for reheating the IHTM solids. The gas causes the solids to flow in a way that causes solid-to-solid contact between the hot or burning char and the IHTM solids. This direct solids-to-solids contact allows heat to transfer by conduction rather than mostly by convection thereby producing higher heat transfer coefficients than found in fluidized beds. This and other differences between the spouted-bed combustor and conventional packed-bed heating of IHTM solids and fluidized bed combustors are best understood by reference to how the spouted bed is created and by reference to solids and gas movement in the spouted-bed combustor.

When combustor 17 is partially filled with solids and an oxidizing gas is injected upwardly through the bed at low gas rates, the gas simply passes up through the bed without disturbing the particles. This is what would occur in a conventional packed bed heater. The combustor may be operated at any suitable pressure. As the gas flow rate is increased, particles just above the gas inlet are pushed back causing an empty cavity to form just above the inlet. As the gas flow increases, the cavity continues to elongate in an internal spout until enough solids are displaced and the internal spout breaks through the upper bed surface. When this happens, the entire bed mobilizes and steady spouting sets in. Particles entering the spout accelerate and then decelerate until they reach zero upward velocity at a point above the top of bed where the solids undergo a sort of fountain-like outward or radial movement and then reverse direction of movement downward in a sort of downward moving bed called an annulus. The particles in the annulus undergo a dual movement, that is, downward along the length of the bed and radially toward the spout-annulus interface. Solids passing through the spout-annulus interface are entrained by the gas in the spout forming a dilute phase central core of upward co-current moving gas and solids.

In the spout, the gas flows upward and exits the combustor through overhead line 20, but before the gas reaches the top of bed, it starts to flare outward into the annulus thereby creating a very dense phase gas-solids annular region with countercurrent movement of the solids and gas. This dense phase action behaves like a well-mixed liquid which combines with the raining fountain of solids from the spout and cyclic movement of the solids in the annulus to provide a high rate of heat transfer.

From the above, it can be readily seen that the spouted-bed char combustor of this coal gasification-IHTM reheating process is radically different from a conventional fluidized combustor and packed-bed hot gas-solids unit.

Generally, a cylindrical combustor will be used, but entirely conical and rectangular vessels may be used. Moreover, a multiple spout vessel may be used. Spouting occurs over a definite range of gas velocity for a given combustion of gas, solids, and vessel configuration. This is ample latitude between the minimum and maximum spouting velocity so that the velocity for any set of conditions may be readily determined and may be varied by a large enough factor as to achieve and maintain stability of the system. For a given bed depth, increasing spouting gas rate increases both total solids flow and cross flow. The bed will have substantial depth, that is at least one vessel diameter or cross-sectional width measured from the gas inlet to the top of bed annulus. At much shallower depths, the system becomes hydrodynamically different from a true spouted-bed. Generally, increasing the bed depth increases both total solids flow rate and solids cross flow rate.

To enhance flow of solids from the annulus into the spout and eliminate dead spaces at the bottom of the combustor, it is common to use a diverging conical base with air injection at the truncated apex of the cone. But a flat base may be used without adversely affecting spouting stability. Too steep a cone will cause the spout to be less stable. The limiting cone angle depends to some extent on the internal friction characteristics of the solids, but in general it can be said that the cone angle will be 40 degrees or less.

Since the annular solids are in an aerated state, the solids may readily be discharged from the spouted-bed combustor at any desirable point. The hot IHTM solids are shown as passing through hot IHTM line 13 which is just below the top of the bed. An overflow pipe may be used instead of line 13.

The process of this disclosure may be carried out at any pressure or temperature which will produce the desired degree of char burning and IHTM temperature. Generally, the temperature will be at least 1,200° F. at the combustor hot IHTM outlet and the pressure of the combustor will be ambient by at least 5 p.s.i.g.

The oxidizing or combustion supporting gas may be two separate gases introduced into combustor 17. Moreover, two or more separate spouts may be formed if desired by flowing the combustion supporting gas upwardly at two or more points and forming an upwardly flowing spout above each of the points. Various gas inlet designs may be used for improved stability, like for example, a constricting orifice, a straight inlet pipe or a converging nozzle protruding into the conical part of the vessel, or a use of a truncated conical plug insert above the inlet opening.

Other modifications and variations obvious to those skilled in this art may be used. For example, the solids are shown as being fed and removed by gravity through conduits, but conventional lock hoppers may be added. Moreover, other solids moving means may be used, such as, for example, star wheel feeders or movers.

The embodiments of the invention in which an exclusive property or privilege is claimed are defined as follows:

I claim:

1. In a method for the gasification of coal in a coal gasification reactor using hot inert heat transfer medium solids, which method includes removing a mixture of solids comprising unreacted char and inert transfer medium from said gasification reactor and the char is burned to supply heat for heating the inert heat transfer medium solids, the improvement comprising:

(a) passing a part of said solids directly into to a spouted-bed char combustor and combining a part of said solids with combustion supporting gas before said gas is flowed in step (b) into said combustor;

(b) flowing a combustion supporting gas into said combustor at a first point;

(c) flowing said gas upwardly in said combustor at a volume and rate such that an upwardly flowing spout of said solids is formed above said first point, but below the volume and rate at which said gas would elutriate a majority of said solids in said combustor;

(d) burning char in said combustor; and (e) passing heated inert transfer medium solids from said combustor to said coal gasification reactor.

2. In the method of claim 1 wherein the combustion supporting gas is comprised of air.

3. In a method for the gasification of coal in a coal gasification reactor using hot inert heat transfer medium solids, which method includes removing a mixture of solids comprising unreacted char and inert transfer medium from said gasification reactor and the char is burned to supply heat for heating the inert heat transfer medium solids, the improvement comprising:

(a) passing a part of said solids directly into a spouted-bed char combustor and combining a part of said solids with a combustion supporting gas before said gas is flowed in step (b) into said combustor;

(b) flowing a combustion supporting gas comprised of air into said combustor at a first point;

(c) flowing said gas upwardly in said combustor at a volume and rate such that an upwardly flowing spout of said solids is formed above said first point, but below the volume and rate at which said gas would elutriate a majority of said solids in said combustor;

(d) burning char in said combustor; and (e) passing heated inert transfer medium solids from said combustor to said coal gasification reactor.

4. In the method of claim 3 wherein the combustion supporting gas is comprised of air.

* * * * *